US008049170B2

(12) United States Patent
Sekoguchi et al.

(10) Patent No.: US 8,049,170 B2
(45) Date of Patent: Nov. 1, 2011

(54) INDUCTION ELECTRODE, ION GENERATION ELEMENT, ION GENERATION APPARATUS, AND ELECTRIC EQUIPMENT

(75) Inventors: Yoshinori Sekoguchi, Nara (JP); Yasuhiro Iwashita, Shijonawate (JP)

(73) Assignee: Sharp Kabushiki Kaisha, Osaka (JP)

( * ) Notice: Subject to any disclaimer, the term of this patent is extended or adjusted under 35 U.S.C. 154(b) by 193 days.

(21) Appl. No.: 12/300,106

(22) PCT Filed: May 1, 2007

(86) PCT No.: PCT/JP2007/059295

§ 371 (c)(1),
(2), (4) Date: Nov. 7, 2008

(87) PCT Pub. No.: WO2007/129633

PCT Pub. Date: Nov. 15, 2007

(65) Prior Publication Data

US 2009/0140164 A1 Jun. 4, 2009

(30) Foreign Application Priority Data

May 9, 2006 (JP) ..... 2006-129795

(51) Int. Cl.
*H01T 19/00* (2006.01)

(52) U.S. Cl. ..... 250/324; 361/231

(58) Field of Classification Search ..... 250/423 R, 250/423 F, 324, 326, 325; 361/226, 230, 361/231, 234, 235

See application file for complete search history.

(56) References Cited

U.S. PATENT DOCUMENTS

| | | | | |
|---|---|---|---|---|
| 4,210,949 | A * | 7/1980 | Masuda | 361/226 |
| 7,375,945 | B2 * | 5/2008 | Izumi et al. | 361/231 |
| 7,553,353 | B2 * | 6/2009 | Lepage | 96/3 |
| 7,639,472 | B2 * | 12/2009 | Sekoguchi et al. | 361/230 |
| 2006/0232908 | A1 | 10/2006 | Izumi et al. | |
| 2007/0109711 | A1 | 5/2007 | Sekoguchi et al. | |
| 2009/0116162 | A1 * | 5/2009 | Onezawa et al. | 361/213 |

FOREIGN PATENT DOCUMENTS

| | | | |
|---|---|---|---|
| JP | 7-42096 | A | 7/1995 |
| JP | 3028457 | U | 6/1996 |
| JP | 10-199653 | A | 7/1998 |
| JP | 2005-268126 | A | 9/2005 |
| JP | 2006-59716 | A | 3/2006 |
| KR | 10-2005-0099891 | A | 10/2005 |
| TW | 238435 | B | 8/2005 |
| WO | WO 2004/109875 | A1 | 12/2004 |

* cited by examiner

*Primary Examiner* — Kiet Nguyen
(74) *Attorney, Agent, or Firm* — Birch, Stewart, Kolasch & Birch, LLP

(57) ABSTRACT

An ion generation element includes an induction electrode and a plurality of discharge electrodes. The induction electrode is formed of one metal plate. A circumferential portion of a through hole is bent, and a thickness of a wall portion of the through hole is greater than a thickness of a top plate portion. A needle-like tip end of the discharge electrode is located within a range of the thickness of the through hole. Thus, an induction electrode having a structure realizing a small thickness, capable of lessening variation in an amount of ion generation caused by variation in positional relation between the tip end of the discharge electrode and the induction electrode, an ion generation element, an ion generation apparatus, and electric equipment can be obtained.

7 Claims, 6 Drawing Sheets

INDUCTION ELECTRODE, ION GENERATION ELEMENT, ION GENERATION APPARATUS, AND ELECTRIC EQUIPMENT

TECHNICAL FIELD

The present invention relates to an induction electrode, an ion generation element, an ion generation apparatus, and electric equipment, and particularly to a plate-shaped induction electrode combined with a needle-shaped discharge electrode, an ion generation element including the same, an ion generation apparatus, and electric equipment.

BACKGROUND ART

It has generally been known that, by combining a needle electrode serving as a discharge electrode and a plate electrode serving as an induction electrode and by applying a high voltage across the discharge electrode and the induction electrode, dielectric breakdown of air in the vicinity of a tip end portion of the needle electrode occurs and partial discharge takes place. This phenomenon is referred to as corona discharge.

An ion generation element utilizing this corona discharge phenomenon has been realized. Japanese Patent Laying-Open No. 10-199653 (Patent Document 1) discloses an exemplary electrode configuration generating negative ions as the ion generation element. Japanese Patent Laying-Open No. 10-199653 (Patent Document 1) describes the electrode configuration including a discharge electrode having a needle-shaped electrode to which a negative high voltage is applied, a perforated flat electrode provided opposed to the discharge electrode, to which a ground voltage or a positive high voltage is applied, and a cylindrical electrode attached to the perforated flat electrode.

In addition, Registered Japanese Utility Model No. 3028457 (Patent Document 2) also discloses an electrode configuration including a needle-shaped electrode. Registered Japanese Utility Model No. 3028457 (Patent Document 2) describes the electrode configuration including a needle-shaped corona generation electrode, a first opposing electrode in a cylindrical shape, and a second opposing electrode set up within the first opposing electrode, in which a tip end portion of the needle-shaped corona generation electrode is inserted in an opening at one end of the first opposing electrode in a cylindrical shape. In this electrode configuration, corona discharge occurs in the vicinity of the tip end of the needle-shaped electrode by applying a high voltage across the needle-shaped corona generation electrode and the cylindrical opposing electrode.

Patent Document 1: Japanese Patent Laying-Open No. 10-199653

Patent Document 2: Registered Japanese Utility Model No. 3028457

DISCLOSURE OF THE INVENTION

Problems to Be Solved by the Invention

In an example where the induction electrode is formed in a cylindrical shape as in the electrode configuration in Registered Japanese Utility Model No. 3028457 (Patent Document 2), when a plurality of needle-shaped corona generation electrodes serving as the discharge electrode are provided, the cylindrical induction electrodes as many as the corona generation electrodes should also be provided. In addition, in order to set the plurality of cylindrical induction electrodes to the same potential, means for electrically connecting the plurality of cylindrical induction electrodes to one another is required. Moreover, as the induction electrode is in a cylindrical shape, the electrode configuration does not seem suitable for achieving a smaller thickness, i.e., for achieving an ion generation apparatus having a thickness around several mm.

On the other hand, even though a plurality of discharge electrodes are to be provided, it is easy to provide holes as many as the discharge electrodes by using a perforated flat plate as in Japanese Patent Laying-Open No. 10-199653 (Patent Document 1).

According to the electrode configuration in Japanese Patent Laying-Open No. 10-199653 (Patent Document 1), however, in spite of an attempt to set positional relation in a direction of height (a direction of length of the needle-shaped electrode) between the discharge electrode and the perforated flat electrode to prescribed positional relation, the positional relation is actually varied in mass production. As variation in the direction of height particularly affects variation in ion performance to a large extent, suppression of variation in the direction of height is important. Specifically, provided that a voltage applied to the discharge electrode and the perforated flat electrode is constant, discharge is weaker as the tip end of the needle-shaped electrode is located away from the induction electrode, which causes decrease in an amount of generated ions. Therefore, variation in the positional relation between the tip end of the discharge electrode and the induction electrode leads to variation in strength of discharge, which in turn results in variation in the amount of generated ions.

The present invention was made in view of the problems above, and an object of the present invention is to provide an induction electrode capable of achieving a smaller thickness of an ion generation element and an ion generation apparatus and lessening variation in an amount of ion generation caused by variation in positional relation between a tip end of a discharge electrode and the induction electrode, an ion generation element, an ion generation apparatus, and electric equipment.

Means for Solving the Problems

An induction electrode according to the present invention is an induction electrode for generating at least any of positive ions and negative ions through corona discharge for being combined with a discharge electrode, characterized in that the induction electrode is formed of one metal plate, the induction electrode has a plurality of through holes as many as the discharge electrodes, a thickness of a wall portion of the through hole is greater than a thickness of the metal plate as a result of bending of a circumferential portion of the through hole.

According to the induction electrode of the present invention, as the induction electrode is formed of one metal plate, the thickness thereof can be made smaller. In addition, as the circumferential portion of the through hole is bent, the wall portion of the through hole can be greater in thickness than the metal plate, although the induction electrode is formed of one metal plate.

An ion generation element according to the present invention includes the induction electrode described above and a plurality of discharge electrodes. The plurality of discharge electrodes are provided in correspondence with the plurality of through holes respectively, of which needle-like tip end is located within a range of a thickness of the through hole in the induction electrode.

According to the ion generation element of the present invention, by locating the needle-like tip end within the range of the thickness of the through hole, a distance between the induction electrode and the discharge electrode is shortest between the needle-like tip end of the discharge electrode and the circumferential portion of the through hole in the induction electrode. Here, as the circumferential portion of the through hole is greater in thickness than the metal plate, even though the position of the discharge electrode is slightly displaced in a direction of thickness of the circumferential portion, the needle-like tip end remains within the range of the thickness of the through hole. Therefore, the shortest distance between the induction electrode and the discharge electrode is maintained as the distance between the needle-like tip end of the discharge electrode and the circumferential portion of the through hole in the induction electrode, and hence variation in an amount of ion generation caused by variation in the positional relation can be lessened.

In addition, it is not necessary to prepare a tubular electrode member separately from the metal plate such that the wall portion of the through hole is greater in thickness than the metal plate. Therefore, the number of parts can be reduced.

The ion generation element described above preferably further includes a substrate supporting both of the induction electrode and the discharge electrode.

As the substrate supports both of the induction electrode and the discharge electrode such that they are positioned relative to each other, variation in the positional relation between the induction electrode and the discharge electrode can be suppressed.

In the ion generation element described above, preferably, the substrate has a first through hole for supporting the discharge electrode and a second through hole for supporting the induction electrode. The discharge electrode is supported by the substrate in such a manner that it is inserted in the first through hole to penetrate the substrate. The induction electrode has a substrate insertion portion formed by bending the metal plate, and is supported by the substrate in such a manner that the substrate insertion portion is inserted in the second through hole to penetrate the substrate.

Thus, the discharge electrode and the induction electrode are supported by the substrate, and an electric circuit or the like can electrically be connected to each of an end portion of the discharge electrode protruding from a back surface side of the substrate and the substrate insertion portion of the induction electrode.

In the ion generation element described above, preferably, the induction electrode has a substrate support portion formed by bending the metal plate. An end portion of the substrate support portion abuts on a surface of the substrate while the induction electrode is supported by the substrate.

As the induction electrode can be positioned with respect to the substrate by thus bringing the end portion of the substrate support portion in contact with the surface of the substrate, variation in the positional relation between the induction electrode and the discharge electrode can further be suppressed.

In addition, as the end portion of the substrate support portion simply abuts on the surface instead of penetrating the substrate, an insulating distance from the discharge electrode can readily be ensured.

In the ion generation element described above, preferably, the plurality of discharge electrodes have a discharge electrode for generating positive ions and a discharge electrode for generating negative ions.

A substantially equal amount of positive ions $H^+(H_2O)_m$ (m is any natural number) and negative ions $O_2^-(H_2O)_n$ (n is any natural number) in air is generated to emit ions of both polarities, i.e., positive ions and negative ions, so that both ions surround molds or viruses floating in the air, and as a result of action of hydroxyl radicals (.OH) representing active species produced at that time, floating molds or the like can be eliminated.

An ion generation apparatus according to the present invention includes the ion generation element described above, a high-voltage generation circuit portion for boosting an input voltage for applying a high voltage to the induction electrode and the discharge electrode, and a drive circuit portion for driving the high-voltage generation circuit portion upon receiving the input voltage.

According to the ion generation apparatus of the present invention, drive of the high-voltage generation circuit portion is controlled by the drive circuit portion so that a high voltage is applied to the induction electrode and the discharge electrode. Corona discharge is thus produced in the ion generation element described above and ions can be generated.

Electric equipment according to the present invention includes the ion generation apparatus described above, and a blowing portion for sending at least any of positive ions and negative ions generated in the ion generation apparatus on air current.

According to the electric equipment of the present invention, as the ions generated from the ion generation apparatus can be sent on the air current by means of the blowing portion, for example, ions can be emitted from an air conditioner to the outside, or ions can be emitted to the inside or the outside of a refrigerator.

Effects of the Invention

As described above, according to the present invention, a smaller thickness can be achieved by devising a shape of the induction electrode and arrangement of the needle-shaped discharge electrode. In addition, even though there is variation in the direction of thickness in positional relation between the tip end of the discharge electrode and the induction electrode, discharge can be stabilized and the amount of generated ions can be stabilized. Moreover, on the premise that both of positive and negative ions are generated, an effect of smaller thickness and stable ion amount can be obtained.

DESCRIPTION OF THE REFERENCE SIGNS

1 induction electrode; 1*a* top plate portion; 1*b* through hole; 1*c* bent portion; 1*d* substrate insertion portion; 1$d_1$ support portion; 1$d_2$ substrate insertion portion; 1*e* substrate support portion; 2 discharge electrode; 3 substrate; 3*a*, 3*b* through hole; 4 solder; 10 ion generation element; 20 ion generation apparatus; 21 case; 21*a* ion generation portion (hole); 22 power supply input connector; 23 drive circuit; 24 high-voltage generation circuit; 25 positive high-voltage production circuit; 26 negative high-voltage production circuit; 30 air cleaner; 31 front panel; 32 main body; 33 outlet; 34 air inlet; and 35 fan casing.

BEST MODES FOR CARRYING OUT THE INVENTION

An embodiment of the present invention will be described hereinafter with reference to the drawings.

Initially, a configuration of an induction electrode in the present embodiment will be described.

Figure 1:
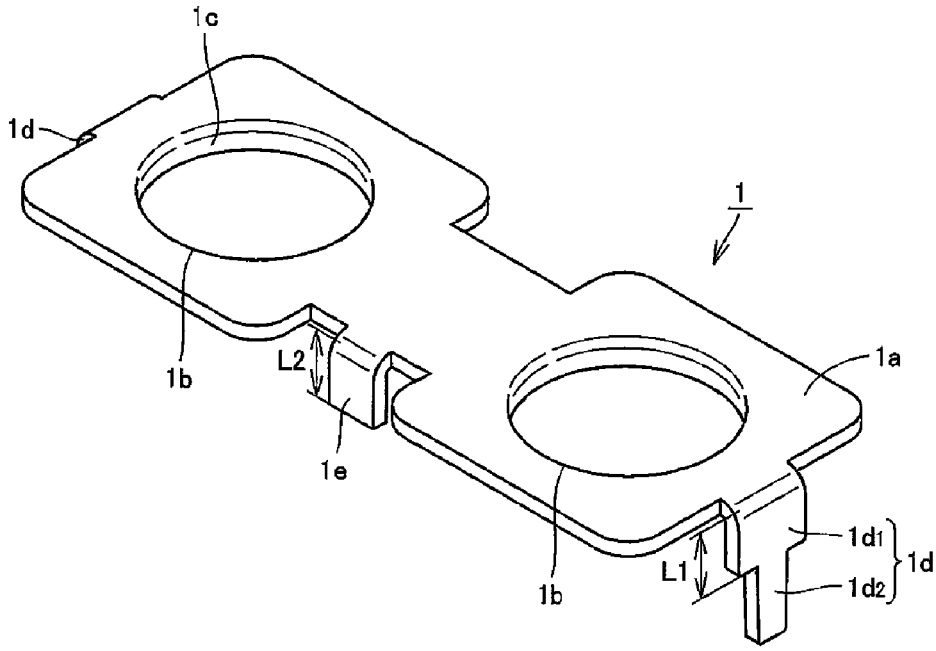
FIG. 1 is a perspective view schematically showing a configuration of an induction electrode in one embodiment of the present invention.
Figure 2:
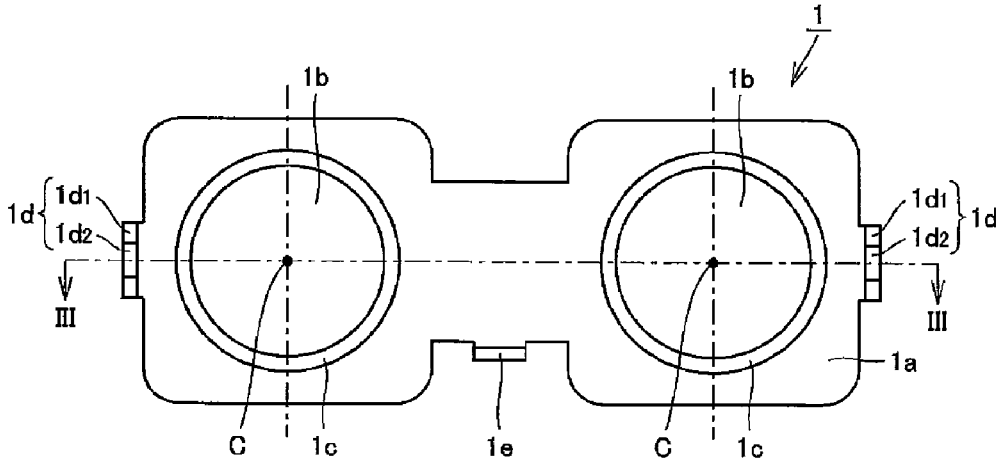
FIG. 2 is a bottom view schematically showing the configuration of the induction electrode in one embodiment of the present invention.

FIGS. 1 and 2 are a perspective view and a bottom view schematically showing the configuration of the induction electrode in one embodiment of the present invention, respectively. In addition, FIG. 3 is a schematic cross-sectional view along the line III-III in FIG. 2.

Figure 3:
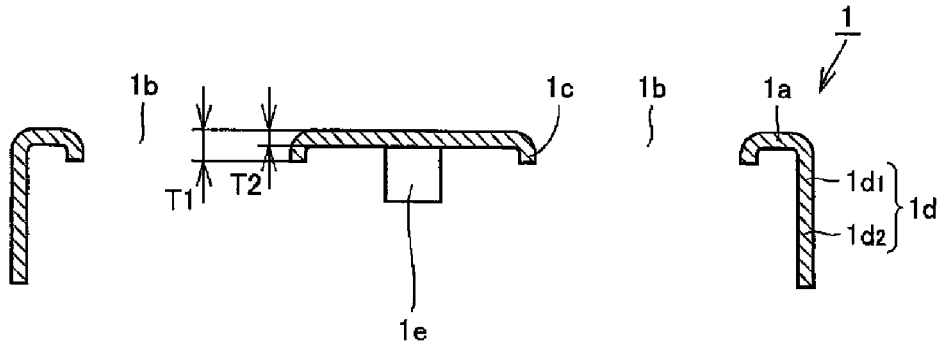
FIG. 3 is a schematic cross-sectional view along the line III-III in FIG. 2.

Referring to FIGS. 1 to 3, an induction electrode 1 in the present embodiment is combined with a needle-shaped discharge electrode for generating at least any of positive ions and negative ions through corona discharge. Induction electrode 1 is formed of one metal plate, and has a plurality of through holes 1*b* as many as the discharge electrodes, that are provided in a top plate portion 1*a*. Through hole 1*b* serves as an opening for emitting ions generated through corona discharge to the outside of an ion generation element.

In the present embodiment, the number of through holes 1*b* is set, for example, to two and a two-dimensional shape of through hole 1*b* is, for example, annular. A circumferential portion of through hole 1*b* is formed as a bent portion 1*c*, that is formed, for example, by bending a metal plate from top plate portion 1*a* with a method such as drawing. Presence of bent portion 1*c* brings about a thickness T1 of a circumferential wall portion of through hole 1*b* greater than a thickness T2 of top plate portion 1*a*.

In addition, induction electrode 1 has a substrate insertion portion 1*d* formed by bending a part of the metal plate from top plate portion 1*a*, for example, at opposing end portions. Substrate insertion portion 1*d* has a support portion 1$d_1$ having a larger width and an insertion portion 1$d_2$ having a smaller width. Support portion 1$d_1$ has one end continuing to top plate portion 1*a* and the other end continuing to insertion portion 1$d_2$.

Moreover, induction electrode 1 may have a substrate support portion 1*e* formed by bending a part of the metal plate from top plate portion 1*a*. Substrate support portion 1*e* is bent in a direction the same as the direction of bending of substrate insertion portion 1*d* (downward in FIG. 3). A length L2 in the direction of bending of substrate support portion 1*e* is substantially the same as a length L1 in the direction of bending of support portion 1$d_1$ of substrate insertion portion 1*d*.

Bent portion 1*c* may be bent in a direction the same as substrate insertion portion 1*d* and substrate support portion 1*e* (downward in FIG. 3), or may be bent in a direction opposite to substrate insertion portion 1*d* and substrate support portion 1*e* (upward in FIG. 3). In addition, bent portion 1*c*, substrate insertion portion 1*d* and substrate support portion 1*e* are bent, for example, substantially at a right angle with respect to top plate portion 1*a*.

According to induction electrode 1 in the present embodiment, as induction electrode 1 is formed of one metal plate, the thickness thereof can be made smaller. A smaller thickness can thus be achieved. In addition, as the circumferential portion of through hole 1*b* is bent as seen in bent portion 1*c*, thickness T1 of the wall portion of through hole 1*b* can be greater than thickness T2 of top plate portion 1*a*, although induction electrode 1 is formed of one metal plate. Thus, variation in the amount of ion generation caused by variation in the positional relation between the tip end of the discharge electrode and induction electrode 1 can be lessened. Moreover, it is not necessary to prepare a tubular electrode member separately from the metal plate such that thickness T1 of the wall portion of through hole 1*b* is greater than thickness T2 of the metal plate, and hence the number of parts can also be reduced.

A configuration of an ion generation element including the induction electrode above will now be described.

Figure 4:
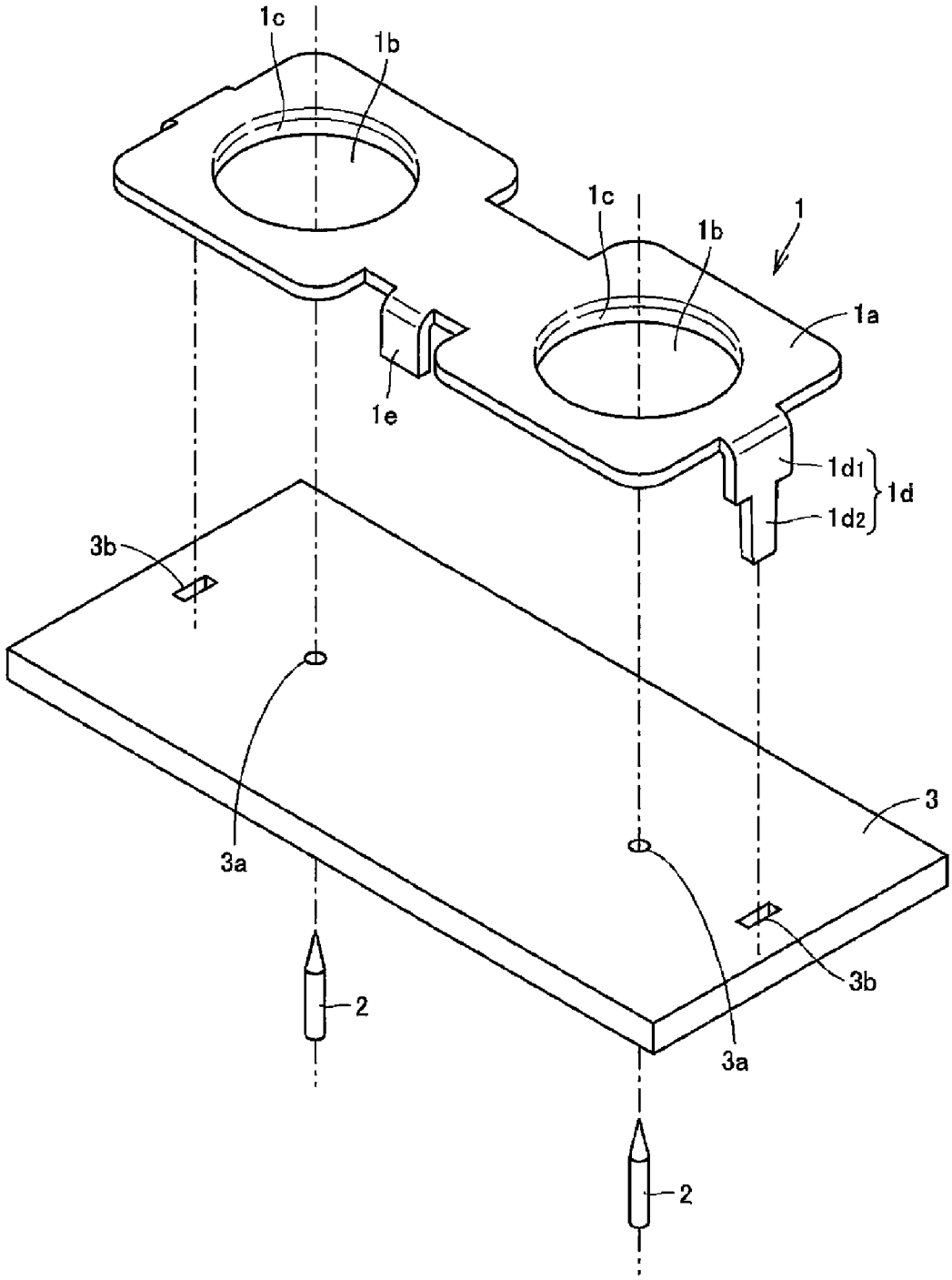
FIG. 4 is an exploded perspective view schematically showing a configuration of an ion generation element including the induction electrode shown in FIGS. 1 to 3.
Figure 5:
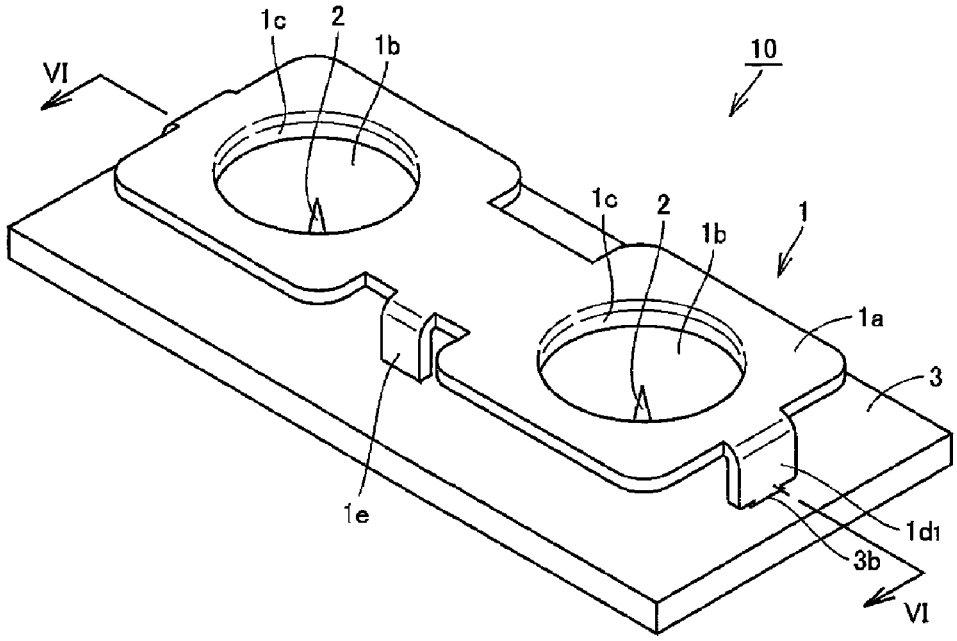
FIG. 5 is an assembly perspective view schematically showing the configuration of the ion generation element including the induction electrode shown in FIGS. 1 to 3.
Figure 6:
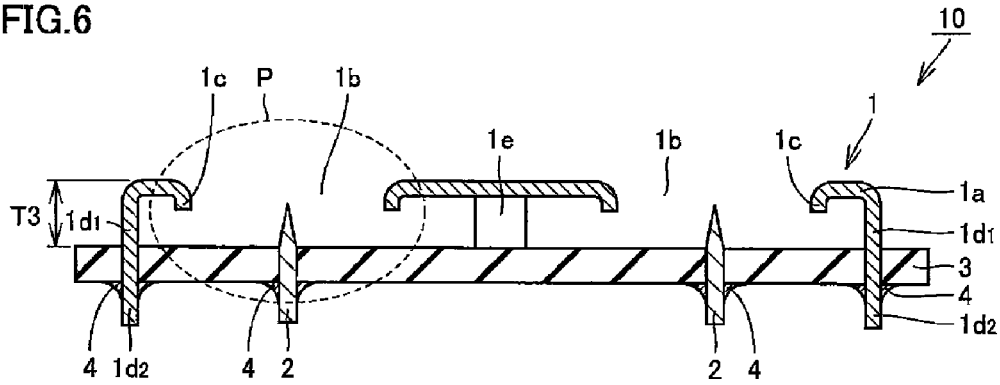
FIG. 6 is a schematic cross-sectional view along the line VI-VI in FIG. 5.
Figure 7:
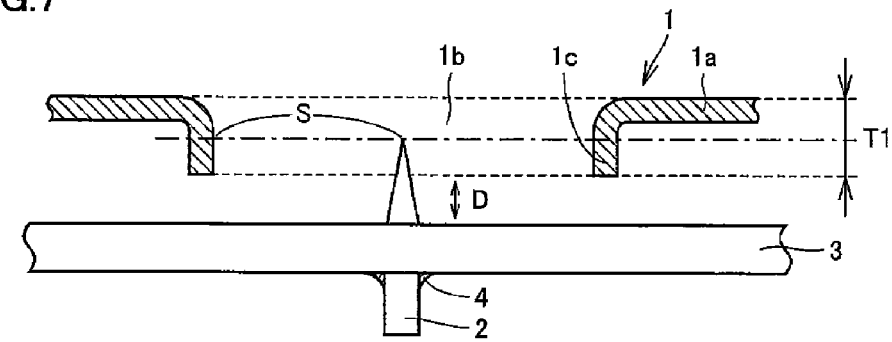
FIG. 7 is an enlarged cross-sectional view of a portion P in FIG. 6.

FIGS. 4 and 5 are an exploded perspective view and an assembly perspective view schematically showing the configuration of the ion generation element including the induction electrode shown in FIGS. 1 to 3, respectively. FIG. 6 is a schematic cross-sectional view along the line VI-VI in FIG. 5. In addition, FIG. 7 is an enlarged cross-sectional view of a portion P in FIG. 6.

Referring to FIGS. 4 to 6, an ion generation element 10 has induction electrode 1 described above, a discharge electrode 2, and a substrate 3. Discharge electrode 2 has a needle-like tip end. Substrate 3 has a through hole 3*a* for insertion of discharge electrode 2 and a through hole 3*b* for insertion of insertion portion 1$d_2$ of substrate insertion portion 1*d*.

Needle-shaped discharge electrode 2 is supported by substrate 3 in such a manner that it is inserted or pressed in through hole 3*a* to penetrate substrate 3. Thus, needle-like one end of discharge electrode 2 protrudes from the surface side of substrate 3, and the other end protruding from the back surface side of substrate 3 can electrically be connected to a lead or an interconnection pattern through a solder 4.

Insertion portion 1$d_2$ of induction electrode 1 is supported by substrate 3 in such a manner that it is inserted in through hole 3*b* to penetrate substrate 3. In addition, the tip end of insertion portion 1$d_2$ protruding from the back surface side of substrate 3 can electrically be connected to a lead or an interconnection pattern through solder 4.

While induction electrode 1 is supported by substrate 3, a step portion present at the boundary between support portion 1$d_1$ and insertion portion 1$d_2$ abuts on the surface of substrate 3. Thus, top plate portion 1*a* of induction electrode 1 is supported at a prescribed distance from substrate 3. In addition, the tip end of substrate support portion 1*e* of induction electrode 1 abuts on the surface of a substrate in an auxiliary manner. Namely, induction electrode 1 can be positioned with respect to substrate 3 in the direction of thickness thereof by means of substrate insertion portion 1*d* and substrate support portion 1*e*.

While induction electrode 1 is supported by substrate 3, discharge electrode 2 is arranged such that the needle-like tip end thereof is located at a center C of annular through hole 1*b* as shown in FIG. 2 and located within a range of thickness T1 of the circumferential portion of through hole 1*b* (that is, a length of bending of bent portion 1*c*) as shown in FIG. 7.

By way of example of dimensions, thickness T1 of the circumferential portion of through hole 1*b* (that is, a length of bending of bent portion 1*c*) is in a range approximately from 1 mm or greater to 2 mm or smaller, and thickness T2 of plate-shaped induction electrode 1 is in a range approximately from 0.5 mm or greater to 1 mm or smaller. In addition, a thickness T3 from the upper surface of substrate 3 to the surface of induction electrode 1 is in a range approximately from 2 mm or greater to 4 mm or smaller. Thus, a thickness T4 of an ion generation apparatus 20 containing ion generation element 10 can be made smaller, for example, in a range approximately from 5 mm or greater to 8 mm or smaller.

In inserting needle-shaped discharge electrode 2 in substrate 3, even with the use of a manufacturing jig, error or variation is caused in the relation of distance between the needle-like tip end of discharge electrode 2 and induction electrode 1. Thickness T1 of the circumferential portion of through hole 1*b* in induction electrode 1 is determined in consideration of such variation. Maximum and minimum position displacement during manufacturing between the needle-like tip end of discharge electrode 2 and through hole 1*b* in induction electrode 1 in inserting needle-shaped discharge electrode 2 into substrate 3 is accommodated within thickness T1. The needle-like tip end of discharge electrode 2 can thus be controlled to be located within a range of thickness T1 of through hole 1*b* in induction electrode 1.

When ions of any one polarity, i.e., either positive ions or negative ions, are to be generated, the needle-like tip end of discharge electrode 2 for generating ions is centered in through hole 1*b* in induction electrode 1 and arranged within a range of thickness T1 of through hole 1*b* in induction electrode 1, so that induction electrode 1 and the needle-like tip end of discharge electrode 2 are opposed to each other with a space filled with air lying therebetween.

Alternatively, in order to emit ions of both polarities, i.e., positive ions and negative ions, the needle-like tip end of discharge electrode 2 for generating positive ions and the needle-like tip end of discharge electrode 2 for generating negative ions are arranged at a prescribed distance from each other, and centered in respective through holes 1*b* in induction electrode 1 and arranged within a range of thickness T1 of through holes 1*b* in induction electrode 1, so that induction electrode 1 and the needle-like tip end of discharge electrode 2 are opposed to each other with a space filled with air lying therebetween.

In ion generation element 10 described above, plate-shaped induction electrode 1 and needle-shaped discharge electrode 2 are arranged at a prescribed distance from each other as described above, and then a high voltage is applied across induction electrode 1 and discharge electrode 2. Then, corona discharge occurs at the tip end of needle-shaped discharge electrode 2. As a result of corona discharge, at least any of positive ions and negative ions is generated, and the ions are emitted to the outside of ion generation element 10 through hole 1*b* provided in induction electrode 1. In addition, by sending air, the ions can more effectively be emitted.

Here, positive ions are cluster ions formed in such a manner that a plurality of water molecules surround a hydrogen ion ($H^+$) and expressed as $H^+(H_2O)_m$ (m is any natural number). In addition, negative ions are cluster ions formed in such a manner that a plurality of water molecules surround an oxygen ion ($O_2^-$) and expressed as $O_2^-(H_2O)_n$ (n is any natural number).

According to ion generation element 10 in the present embodiment, by locating the needle-like tip end of discharge electrode 2 within the range of thickness T1 of through hole 1*b* as shown in FIG. 7, a shortest distance between induction electrode 1 and discharge electrode 2 is achieved by a distance S between the needle-like tip end of discharge electrode 2 and the circumferential portion of through hole 1*b* in induction electrode 1. Here, as thickness T1 of the circumferential portion of through hole 1*b* is greater than thickness T2 of top plate portion 1*a*, even though the position of discharge electrode 2 is slightly displaced in the direction of thickness of the circumferential portion (a direction shown with an arrow D), the needle-like tip end remains within the range of the thickness of through hole 1*b*. Therefore, the shortest distance between induction electrode 1 and discharge electrode 2 is maintained as distance S between the needle-like tip end of discharge electrode 2 and the circumferential portion of through hole 1*b* in induction electrode 1, strength of discharge does not change much, and hence variation in the amount of ion generation is less. Therefore, even though variation in the positional relation in the direction of thickness is caused between induction electrode 1 and discharge electrode 2, variation in the amount of ion generation caused by variation in the positional relation can be lessened.

If the needle-like tip end of discharge electrode 2 is out of the range of the thickness of through hole 1*b*, the shortest distance between the needle-like tip end portion and induction electrode 1 is greater than distance S described above. Therefore, discharge becomes weaker and the amount of generated ions decreases. In addition, if the needle-like tip end of discharge electrode 2 is out of the range of the thickness of through hole 1*b* and protrudes above through hole 1*b*, the tip end of discharge electrode 2 is exposed at the outside of ion generation element 10 and more susceptible to mechanical deformation.

Further, as substrate 3 supports both of induction electrode 1 and discharge electrode 2 such that they are positioned relative to each other, variation in the positional relation between induction electrode 1 and discharge electrode 2 can be suppressed.

Moreover, each of discharge electrode 2 and substrate insertion portion 1*$d_2$* is supported by substrate 3 such that it penetrates substrate 3. Induction electrode 1 and discharge electrode 2 are thus supported by substrate 3, and an electric circuit or the like can electrically be connected to each of the end portion of discharge electrode 2 protruding from the back surface side of substrate 3 and substrate insertion portion 1*$d_2$* of induction electrode 1.

Further, as induction electrode 1 can be positioned with respect to substrate 3 by bringing the end portion of substrate support portion 1*e* in contact with the surface of substrate 3, variation in the positional relation between induction electrode 1 and discharge electrode 2 can further be suppressed. In addition, as the end portion of substrate support portion 1*e* simply abuts on the surface instead of penetrating substrate 3, an insulating distance from discharge electrode 2 can readily be ensured.

Moreover, a substantially equal amount of positive ions $H^+(H_2O)_m$ (m is any natural number) and negative ions $O_2^-(H_2O)_n$ (n is any natural number) in air is generated to emit ions of both polarities, i.e., positive ions and negative ions, so that both ions surround molds or viruses floating in the air, and as a result of action of hydroxyl radicals (.OH) representing active species produced at that time, floating molds or the like can be eliminated.

A configuration of an ion generation apparatus including the ion generation element above will now be described.

Figure 8:
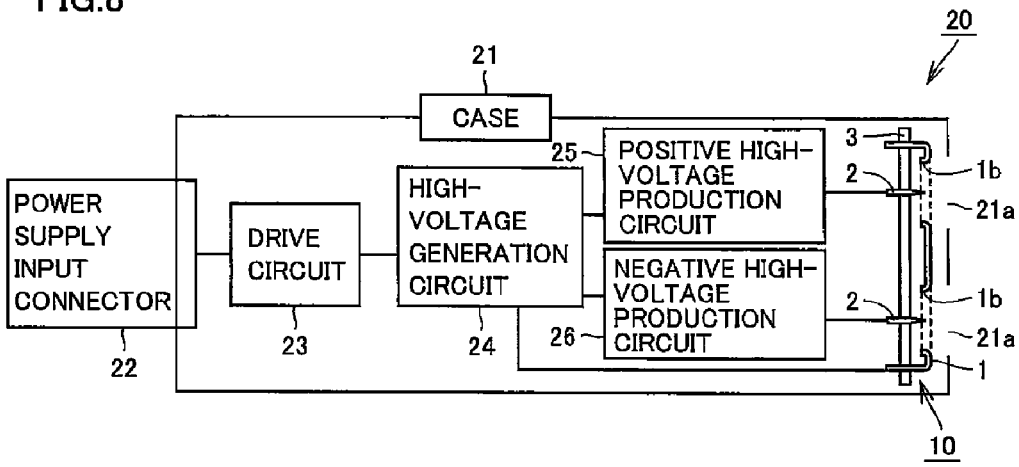
FIG. 8 is a diagram showing functional blocks of an ion generation apparatus including the ion generation element shown in FIGS. 4 to 7.

FIG. 8 is a diagram showing functional blocks of the ion generation apparatus including the ion generation element shown in FIGS. 4 to 7. In addition, FIG. 9 is a perspective view schematically showing the configuration of the ion generation apparatus shown in FIG. 8.

Figure 9:
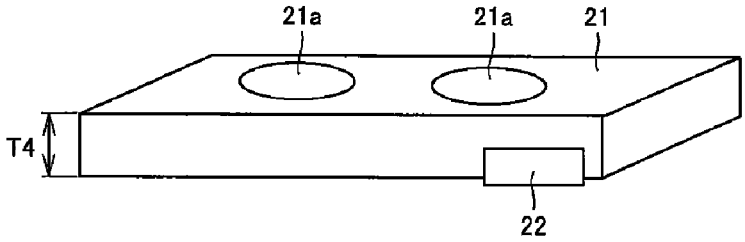
FIG. 9 is a perspective view schematically showing a configuration of the ion generation apparatus shown in FIG. 8.

Referring to FIGS. 8 and 9, ion generation apparatus 20 includes, for example, ion generation element 10 shown in FIGS. 4 to 7, a case 21, a power supply input connector 22, a drive circuit 23, a high-voltage generation circuit 24, a positive high-voltage production circuit 25, and a negative high-voltage production circuit 26. Power supply input connector 22 receives supply of DC power supply or commercial AC power supply serving as input power supply. Drive circuit 23 supplied with an input voltage through power supply input connector 22 drives high-voltage generation circuit 24 to boost the input voltage, to thereby generate a high voltage. High-voltage generation circuit 24 has one end electrically connected to induction electrode 1. In addition, high-voltage generation circuit 24 applies a high voltage positive with respect to induction electrode 1 to needle-shaped discharge electrode 2 generating positive ions through positive high-voltage production circuit 25, and applies a high voltage negative with respect to induction electrode 1 to needle-shaped discharge electrode 2 generating negative ions through negative high-voltage production circuit 26.

Case 21 contains ion generation element 10, power supply input connector 22, drive circuit 23, high-voltage generation circuit 24, positive high-voltage production circuit 25, and negative high-voltage production circuit 26. Power supply input connector 22 is exposed at the outside of case 21 in order to receive supply of external input power supply.

In addition, case 21 has a hole 21*a* in a wall portion opposed to through hole 1*b* of ion generation element 10. Thus, ions generated by ion generation element 10 are emitted through hole 21*a* to the outside of ion generation apparatus 20. As described above, one discharge electrode 2 of ion generation element 10 serves to generate positive ions, while the other discharge electrode 2 serves to generate negative ions. Therefore, one hole 21*a* provided in the case serves as a positive ion generation portion, and the other hole 21*a* serves as a negative ion generation portion.

Ion generation apparatus 20 has thickness T4 not smaller than 5 mm and not larger than 8 mm.

In the ion generation apparatus described above, positive corona discharge is generated at the tip end of one discharge electrode 2 to generate positive ions, and negative corona discharge is generated at the tip end of the other discharge electrode 2 to generate negative ions. Any waveform may be applied here, and a high voltage such as a direct current a positive- or negative-biased alternate-current waveform, a positive- or negative-biased pulse waveform, and the like may be applied. A voltage value should be sufficient to generate discharge, and a voltage region for generating prescribed ion species should be selected.

A configuration of an air cleaner representing an example of electric equipment including the ion generation apparatus above will now be described.

Figure 10:
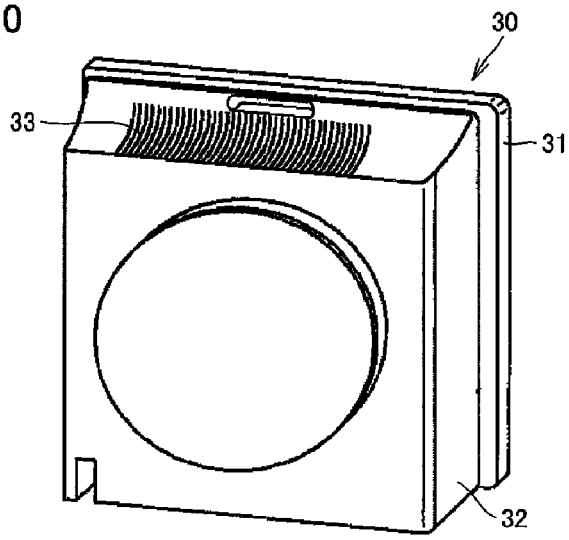
FIG. 10 is a perspective view schematically showing a configuration of an air cleaner including the ion generation apparatus shown in FIGS. 8 and 9.

FIG. 10 is a perspective view schematically showing the configuration of the air cleaner including the ion generation apparatus shown in FIGS. 8 and 9. In addition, FIG. 11 is an exploded view of the air cleaner showing that the ion generation apparatus is arranged in the air cleaner shown in FIG. 10.

Figure 11:
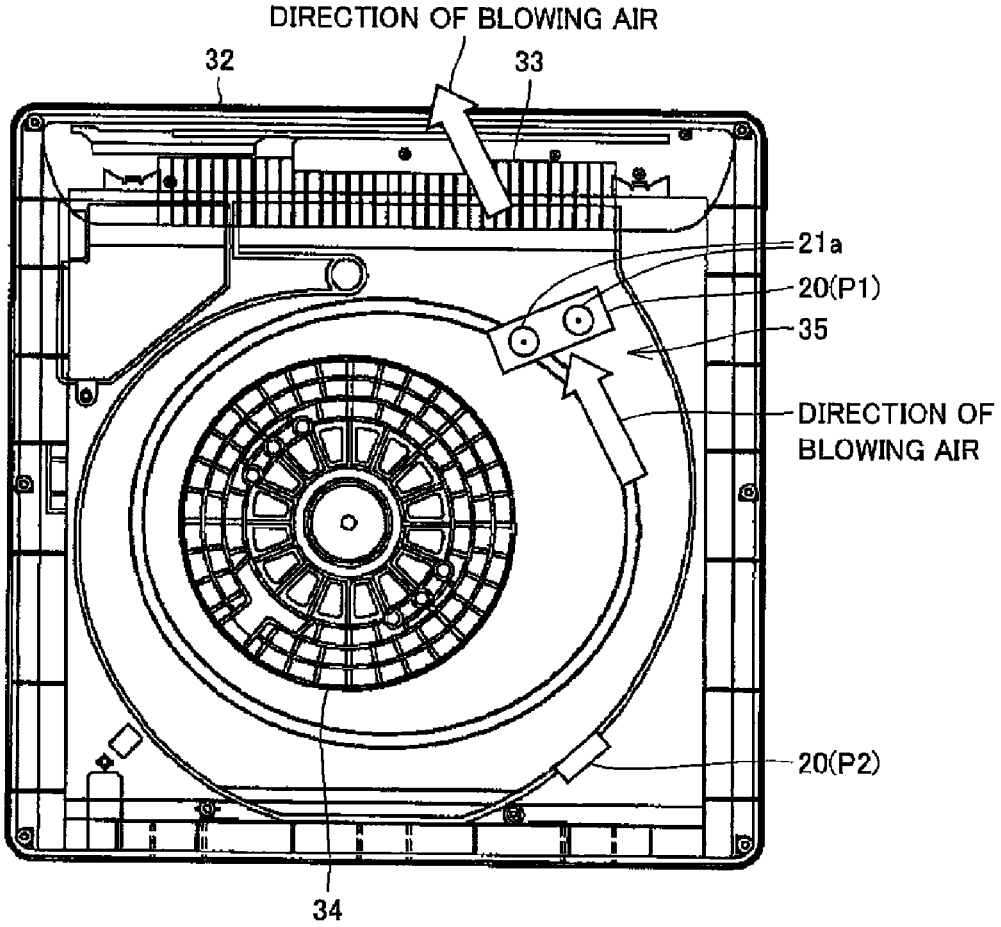
FIG. 11 is an exploded view of the air cleaner showing that the ion generation apparatus is arranged in the air cleaner shown in FIG. 10.

Referring to FIGS. 10 and 11, an air cleaner 30 has a front panel 31 and a main body 32. An outlet 33 is provided in an upper portion of the back of main body 32, and purified air including ions is supplied through outlet 33 into the room. An air inlet 34 is formed in the center of main body 32. Air taken in through air inlet 34 in the front surface of air cleaner 30 is purified by passing through a not-shown filter. The purified air is supplied from outlet 33 through a fan casing 35 to the outside.

Ion generation apparatus 20 shown in FIGS. 8 and 9 is attached to a part of fan casing 35 forming a passage for purified air. Ion generation apparatus 20 is arranged such that ions can be emitted from hole 21*a* serving as the ion generation portion onto air current described above. For example, ion generation apparatus 20 may be arranged at a position in the air passage, such as a position P1 relatively close to outlet 33 or a position P2 relatively far from the same. By thus causing air to pass ion generation portion 21*a* of ion generation apparatus 20, air cleaner 30 can have an ion generation function to supply ions together with purified air from outlet 33 to the outside.

According to air cleaner 30 of the present embodiment, as ions generated by ion generation apparatus 20 can be sent on the air current by means of a blowing portion (air passage), ions can be emitted to the outside of the cleaner.

Though the air cleaner representing an example of the electric equipment has been described in the present embodiment, the present invention is not limited thereto, and the electric equipment may otherwise be an air-conditioner, a refrigerator, a sweeper, a humidifier, a dehumidifier, an electric fan heater, and the like, and any electric equipment having a blowing portion for sending ions on an air current may be adopted.

It should be understood that the embodiments disclosed herein are illustrative and non-restrictive in every respect. The scope of the present invention is defined by the terms of the claims, rather than the description above, and is intended to include any modifications within the scope and meaning equivalent to the terms of the claims.

INDUSTRIAL APPLICABILITY

The present invention is particularly advantageously applicable to a plate-shaped induction electrode combined with a needle-shaped discharge electrode, an ion generation element including the same, an ion generation apparatus, and electric equipment.

The invention claimed is:

1. An ion generation element, comprising:

an induction electrode, and a plurality of needle-like discharge electrodes each for generating at least any of positive ions and negative ions through corona discharge by being combined with a discharge electrode, wherein the induction electrode is formed of one metal plate, and has a plurality of through holes having a circular shape in plan view, as many through holes as said discharge electrodes, a thickness of a wall portion of said through hole is greater than a thickness of said metal plate as a result of bending of a circumferential portion of said through hole, and said plurality of discharge electrodes, each has a needle-like tip end, are provided in correspondence with said plurality of through holes respectively, and the needle-like tip end is centered in said circular-shaped through hole and located within a range of a thickness of a wall of said through hole in said induction electrode.

2. The ion generation element according to claim 1, further comprising a substrate supporting both of said induction electrode and said discharge electrodes.

3. The ion generation element according to claim 1, wherein said plurality of discharge electrodes have a discharge electrode for generating positive ions and a discharge electrode for generating negative ions.

4. An ion generation apparatus, comprising:

said ion generation element according to claim 1;

a high-voltage generation circuit portion for boosting an input voltage for applying a high voltage to said discharge electrodes; and a drive circuit portion for driving said high-voltage generation circuit portion upon receiving said input voltage.

5. Electric equipment, comprising:

said ion generation apparatus according to claim 4; and a blowing portion for sending at least any of positive ions and negative ions generated in said ion generation apparatus on air current.

6. An ion generation element, comprising:

an induction electrode; and a substrate supporting both of said induction electrode and a plurality of discharge electrodes; and said plurality of discharge electrodes each for generating at least any of positive ions and negative ions through corona discharge, wherein the induction electrode is formed of one metal plate, and has a plurality of through holes having a circular shape in plan view, as many through holes as said discharge electrodes, a thickness of a wall portion of said through hole is greater than a thickness of said metal plate as a result of bending of a circumferential portion of said through hole, said plurality of discharge electrodes, each has a needle-like tip end, are provided in correspondence with said plurality of through holes respectively, and the needle-like tip end is centered in said circular-shaped through hole and located within a range of a thickness of said through hole in said induction electrode, said substrate has a first through hole for supporting each of said plurality of discharge electrodes and a second through hole for supporting said induction electrode, each of said plurality of discharge electrodes is supported by said substrate in such a manner that each of said plurality of discharge electrodes is inserted in a corresponding said first through hole to penetrate said substrate, said induction electrode has at least one support portion formed by bending said metal plate, and said at least one support portion includes a substrate insertion portion, and said induction electrode is supported by said substrate in such a manner that said substrate insertion portion is inserted in said second through hole to penetrate said substrate.

7. An ion generation element, comprising:

an induction electrode; and a substrate supporting both of said induction electrode and a plurality of discharge electrodes; and said plurality of discharge electrodes each for generating at least any of positive ions and negative ions through corona discharge, wherein the induction electrode is formed of one metal plate, and has a plurality of through holes having a circular shape in plan view, as many through holes as said discharge electrodes, a thickness of a wall portion of said through hole is greater than a thickness of said metal plate as a result of bending of a circumferential portion of said through hole, said plurality of discharge electrodes, each has a needle-like tip end, are provided in correspondence with said plurality of through holes respectively, and the needle-like tip end is centered in said circular-shaped through hole and located within a range of a thickness of said through hole in said induction electrode, said induction electrode has a substrate support portion formed by bending said metal plate, and an end portion of said substrate support portion abuts on a surface of said substrate while said induction electrode is supported by said substrate that also supports said plurality of discharge electrodes.

* * * * *